US006192643B1

(12) United States Patent
Zadok

(10) Patent No.: US 6,192,643 B1
(45) Date of Patent: Feb. 27, 2001

(54) MODULAR POOL ENCLOSURE SYSTEM HAVING AESTHETIC APPEAL

(76) Inventor: Yigel Zadok, 1801 NW. 64th St., Ft. Lauderdale, FL (US) 33309

( * ) Notice: Subject to any disclaimer, the term of this patent is extended or adjusted under 35 U.S.C. 154(b) by 0 days.

(21) Appl. No.: 09/231,883

(22) Filed: Jan. 14, 1999

(51) Int. Cl.[7] ..... E04H 3/00

(52) U.S. Cl. ..... 52/648.1; 52/DIG. 17; 52/79.12; 52/204.1; 52/222; 52/591.1; 52/656.7

(58) Field of Search ..... 52/DIG. 17, 222, 52/79.9, 79.12, 204.1, 580, 591.1, 648.1, 652.1, 656.1, 656.2, 656.7, 656.9, 655.1

(56) References Cited

U.S. PATENT DOCUMENTS 3,143,165 * 8/1964 Lewis et al. .
3,387,415 * 6/1968 McFarlane ..... 52/222
3,729,884 * 5/1973 Dunn et al. ..... 52/222 X
3,778,175 * 12/1973 Zimmer ..... 52/656.9
4,057,941 * 11/1977 Schwartz ..... 52/DIG. 17 X
4,188,764 * 2/1980 Gode ..... 52/656.1
4,274,234 * 6/1981 Abell ..... 52/222 X
4,860,778 * 8/1989 Pohl ..... 135/97
4,928,470 * 5/1990 Perez ..... 52/656.9
5,090,164 * 2/1992 Mische ..... 52/DIG. 17 X
5,224,306 * 7/1993 Cramer ..... 52/222 X
5,333,425 * 8/1994 Nickerson et al. ..... 52/222
5,555,681 * 9/1996 Cawthon ..... 52/79.5 X
5,603,191 * 2/1997 Wu ..... 52/204.1
5,660,002 * 8/1997 Lashinger ..... 52/222 X
5,901,523 * 5/1999 Tasi ..... 52/656.9 X
5,904,022 * 5/1999 Zadok ..... 52/656.9 X

* cited by examiner

*Primary Examiner*—Beth A. Stephan
*Assistant Examiner*—Brian E. Glessner
(74) *Attorney, Agent, or Firm*—Ronald E. Smith; Smith & Hopen, P.A.

(57) ABSTRACT

An aesthetic pool enclosure of modular design includes cover members that hide from view various utilitarian structural components such as bolts, screws, rubber splines for holding screens, and the like. The structure is made of extruded posts and beams and interlocking members for interlocking the posts and beams to one another to reduce the number of fasteners needed and to provide enhanced strength of the finished assembly. The extruded pieces include corner posts for ninety and sixty degree corners, doorjambs, bottom door sweeps, and other specialized parts for completing the assembly. Many of the parts are snap fit to one another to further reduce the number of fasteners required to assemble the enclosure and to facilitate the construction process.

18 Claims, 14 Drawing Sheets

MODULAR POOL ENCLOSURE SYSTEM HAVING AESTHETIC APPEAL

BACKGROUND OF THE INVENTION

1. Field of the Invention

This invention relates, generally, to the art of building construction. More particularly, it relates to a construction system for building a pool enclosure of modular components where various utilitarian parts are covered by aesthetically-pleasing components.

2. Description of the Prior Art

All pool enclosures heretofore known are utilitarian structures lacking aesthetic appeal. The art has long provided pool enclosures where fastening screws, screen-retaining rubber splines, and the like are exposed to view. These structures are often attached to beautiful homes and serve to cheapen the home. Attractive or pleasing-to-the-eye pool enclosures having aesthetic means for covering utilitarian bolts and the like are not found in the prior art.

Pool enclosures of the prior art are also custom-built structures that are not easy to erect. They are made of generic aluminum posts and beams that have no particular means facilitating their interconnection with one another. Thus, the parts must be cut to size and fastened together with unsightly fastening means and, as already mentioned, those fastening means are exposed to view.

There is a clear need in the pool enclosure industry for a system that provides a pool enclosure having the appearance of a work of art rather than just a utilitarian structure. Moreover, there is a need for an aesthetic structure of modular construction so that aluminum beams could be interlocked with one another in a way that would reduce the number of fastening means needed and in a way that would enable the fastening means to be hidden from view. The needed pool enclosure would enhance the appearance of the finest homes and add significant value thereto, rather than detract therefrom as is the case with the systems known prior to this disclosure.

However, at the time the present invention was made, the need for aesthetics was not apparent to the pool enclosure industry, nor was there anything in the art that would have suggested to workers of ordinary skill in the art how a beautiful pool enclosure could be built.

SUMMARY OF THE INVENTION

The long-standing but heretofore unrecognized and unfulfilled need for an aesthetically-pleasing modular pool enclosure system having posts and beams and other miscellaneous parts that interlock with one another with a minimum of fastening members and which includes means for hiding such fastening members is now met.

The novel pool enclosure includes a plurality of extrusion members for providing posts and beams that collectively form a pool enclosure when assembled; each of the extrusion members has at least a first wall with an attachment means formed thereon along a predetermined extent thereof.

A plurality of aesthetic cover members of differing constructions are adapted for snap-fit engagement with the attachment means and serve to conceal the attachment means to which they are engaged. Each aesthetic cover member of the plurality of cover members has a first side adapted to snap-fittingly engage an associated attachment means and a second side provides an aesthetic cover.

The plurality of aesthetic cover members includes a pair of confronting cover members especially designed for engaging the edge of a screen in a highly aesthetic way. Specifically, each member of the pair has a first side adapted to snap-fittingly engage an associated attachment means of a post or beam and a second side providing an aesthetic cover that conceals the screen-engaging means. In this way, the attachment means between adjoining posts and beams and the screen-engaging means for all screen edges are concealed from view when the pool enclosure is fully assembled.

More particularly, each cover member of the pair of confronting cover members has an outboard end and an inboard end, and the respective inboard ends of the confronting cover members includes screen-engaging means for engaging an edge of a screen.

An aesthetic top cover member has a first side adapted to snap-fittingly engage the attachment means of a sloped or level roof beam along a predetermined extent thereof. It also has an aesthetic second side including a uniquely positioned screen-engaging means for engaging an edge of a screen that forms a part of a roof of the pool enclosure. The screen-engaging means of the top cover member is positioned adjacent an edge of the aesthetic first side of the top cover member and the second side of the top cover member is snap-fittingly engaged only to beams that form a part of a roof of the pool enclosure. The edge-mounting of the screen-engaging means positions a screen in substantially flush relation to the beams that form a part of the roof so that debris atop the roof is not retained by the top cover member.

The attachment means has two primary structural types, each designed to snap-fittingly engage the other. In the first type of attachment means, there are two pairs of inwardly turned flanges and in the second type of attachment means, there are two pairs of outwardly turned flanges. Each pair of inwardly turned flanges creates a pair of overhangs which respectively receive a mating pair of outwardly turned flanges that occupy the respective overhang areas and which are locked therewithin when an extrusion member having an attachment means of the first type is snap-fittingly engaged to an extrusion member having an attachment means of the second type.

The invention further includes a novel screen door construction and numerous other unique features that will be introduced in the detailed description that follows.

It is the primary object of this invention to revolutionize the pool enclosure industry by providing the first modular pool enclosure system having a revolutionary degree of aesthetic appeal.

A more specific object is to provide a pool enclosure system where all utilitarian fastening members are hidden from view and covered by aesthetically-appealing cover members.

A still more specific object is to provide screen-engaging means that conceal from view the rubber strips required to retain screen edges in place.

Another specific object is to provide screen-engaging means, used in the roof part of a pool enclosure, that do not trap debris such as leaves atop said roof part.

Another major object is to provide a modular pool enclosure system where the majority of the parts are snap-fittingly engaged to one another, making the structure very easy to assemble.

Another important object is to provide a pool enclosure system that is highly versatile so that it can be erected in almost unlimited environments.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, in connection with the accompanying drawings, in which.

DETAILED DESCRIPTION OF THE PREFERRED EMBODIMENT

Figure 1:
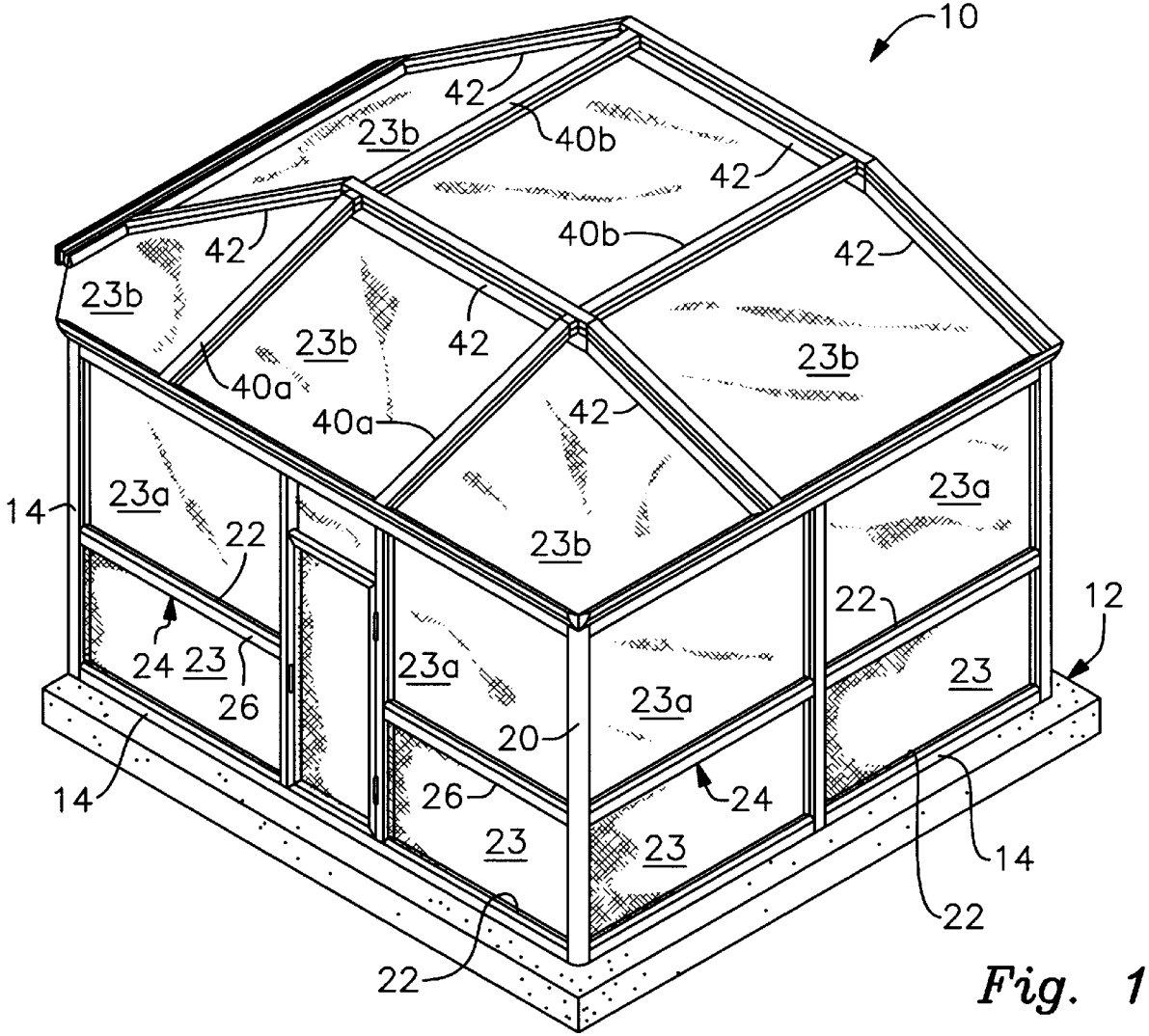
FIG. 1 is a perspective view of a full mansard pool enclosure.

Referring now to FIG. 1, it will there be seen that an illustrative embodiment of the invention is denoted as a whole by the reference numeral 10.

Pool enclosure 10 is built atop a flat concrete slab 12. One or more sides thereof may be attached to an existing structure, not shown. Enclosure 10 can also stand freely without attachment to another structure.

The enclosure style depicted in FIG. 1, including horizontal as well as sloped roof sections, is known in the industry as a full mansard enclosure.

The extruded, modular parts used in the novel pool enclosure will be described. How the parts are interconnected to one another will then be described.

Figure 2:
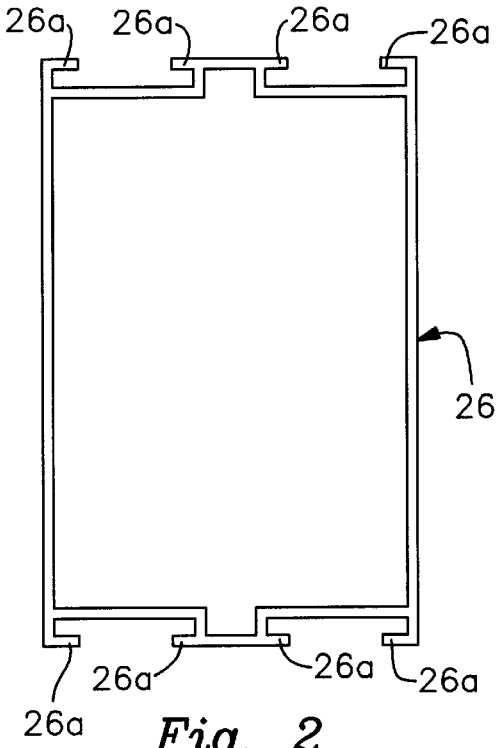
FIG. 2 is an end view of an elongate aluminum extrusion that functions as a beam or column or miscellaneous part of the novel construction.

Extrusion member 26, depicted in FIG. 2, is an elongate, hollow, generally parallelepiped member having flat side walls and top and bottom walls with attachment means formed therein. More particularly, the attachment means includes two pairs of parallel, inwardly turned, longitudinally-extending flanges, collectively denoted 26*a*. Each pair of inwardly turned flanges defines a pair of overhangs.

Figure 3:
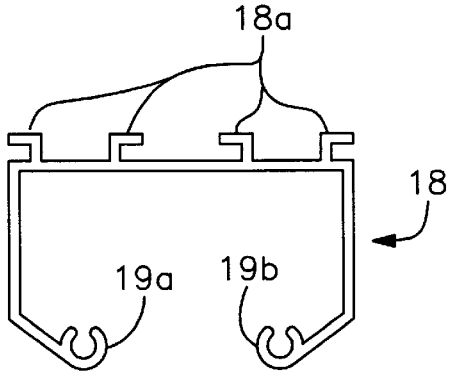
FIG. 3 is an end view of a novel connecting bracket.

Connecting member 18, depicted in FIG. 3, includes a pair of flat side walls, each of which has an inwardly-turned bend formed therein so that the respective free or distal ends of said side walls are disposed in closer proximity to one another than the respective proximal ends thereof. Screw-receiving sleeves 19*a*, 19*b* are formed in each of said free ends.

The attachment means of connecting bracket 18 includes two pairs of parallel, outwardly turned, longitudinally-extending flanges, collectively denoted 18*a*.

Figure 20:
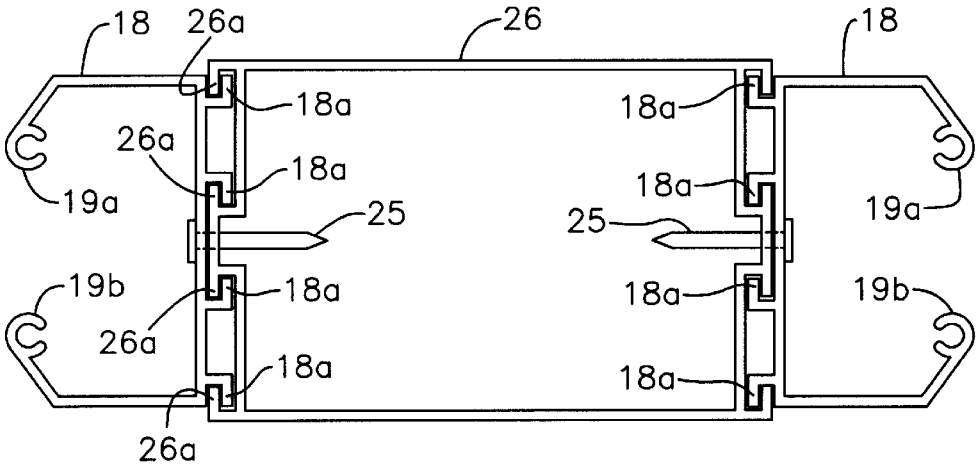
FIG. 20 is an end view of an assembly of the parts depicted in FIGS. 2 and 3.

FIG. 20 indicates how flanges 18*a* of connecting member 18 interlock with flanges 26*a* of extrusion member 26. Flanges 18*a* are respectively received within the overhangs defined by flanges 26*a* and such reception tightly secures parts 18 and 26 to one another. The fastener members denoted 25 in FIG. 20 further enhance the union between such parts.

Figure 4:
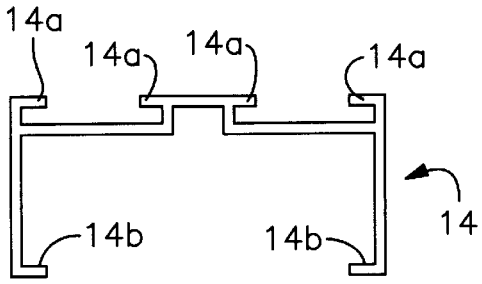
FIG. 4 is an end view of an open-back beam or column.

Open-back beam 14 of FIG. 4 includes a pair of flat side walls and a pair of inwardly turned flanges 14*b* that overlie a support surface when pool enclosure 10 is constructed; flanges 14*b* are secured to the support surface by conventional means. Open-back beam 14 further includes base wall having two pairs of inwardly turned flanges 14*a* formed therein; said flanges have the same construction and function as flanges 26*a* of extrusion member 26.

Figure 5A:
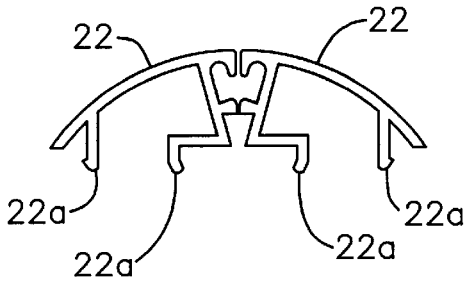
FIG. 5A is an end view of a pair of confronting rounded clips having a flat spline.
Figure 5B:
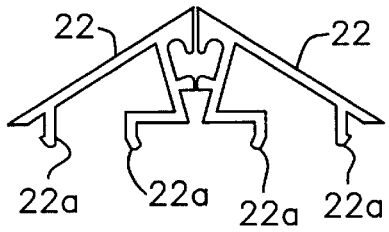
FIG. 5B is an end view of a pair of confronting tapered clips having a flat spline.

A pair of confronting, rounded clips 22, 22 are depicted in side elevation in FIG. 5A and a pair of confronting, tapered clips, also denoted 22, 22, are depicted in FIG. 5B. Each of the clips is depicted as having a cavity at its inboard end for the reception of a flat spline of the type for holding a screen edge; each cavity could also be round to accommodate a round spline.

Each of said clips 22 includes a pair of truncate outwardly-turned flanges, collectively denoted 22*a,* that snap-fittingly engage inwardly-turned flanges such as flanges 26*a* of extrusion member 26, flanges 14*a* of open-back beam 14, and similar flanges on other parts of the novel pool enclosure. Note the barbs at the respective distal free ends of said outwardly-turned flanges 22*a*. Said barbs permit snap-fit engagement of clips 22 to their respective posts or beams while preventing facile removal thereof.

The choice as to whether to use the clips of FIGS. 5A or 5B in any particular application is a matter of aesthetics since both clips perform the same functions. The functions are to aesthetically cover flanges such as 26*a* (FIG. 2) or flanges 14*a* (FIG. 4) and other such flanges while providing a means for engaging the edge of a screen in a way that hides the rubber spline that overlies a screen edge and holds it into position. Moreover, as is clear from FIGS. 5A and 5B, the screen emerges from the center of the pair of clip members, further enhancing the aesthetic appeal of the structure of which the clips form a part. FIGS. 5A, 5B, 6, and 21–24 also disclose that the screen-engaging means, including a spline 27 positioned within an elongate cavity 31 where the spline overlies the edge of a screen in a well-known manner, is structurally independent of the flange means for attaching each aesthetic cover member to its associated extrusion member. In the embodiments of FIGS. 5A, 5B, and 22–24, the screen-engaging means is positioned between the aesthetic side of the cover member and the attachment means. The same observation is essentially true for the embodiments of FIGS. 6 and 21, for example, because the screen-engaging function and the attachment function are clearly structurally independent of one another. It could also be said that the screen-engaging means of such embodiments is also positioned between the aesthetic cover side of the aesthetic cover member and the attachment means because the screen-engaging means is recessed with respect to said aesthetic cover side and is thus between said aesthetic cover side and said attachment means.

Figure 6:
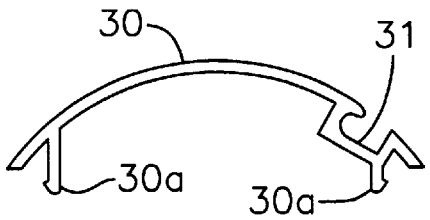
FIG. 6 is an end view of a top snap clip having a flat spline.

FIG. 6 depicts in end view an elongate top snap member 30 having an arcuate top wall, a cavity 31 for accommodating a flat spline, and a pair of outwardly-turned truncate flanges 30*a,* 30*a*. Snap member 30 performs a function much like that of clips 22, 22 (FIGS. 5A and 5B) but a single snap member 30 provides an aesthetic cover means. For example, see FIG. 21 where flanges 30*a,* 30*a* are in snap-fit engagement with a pair of attachment means 28*b,* 28*b*.

Figure 7:
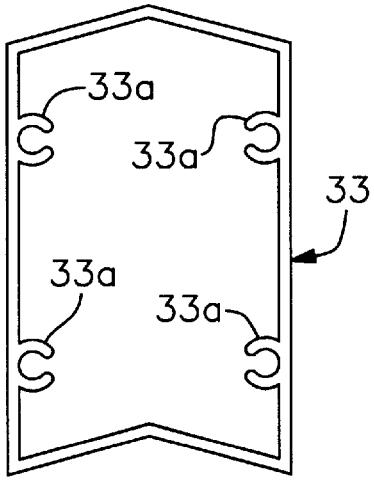
FIG. 7 is an end view of a thirty degree purlin splice.

The box-like member of FIG. 7 is a thirty degree purlin splice member 33. It has a plurality of longitudinally-extending screw-receiving sleeves, collectively denoted 33*a,* formed on respective inboard sides of its flat side walls.

Figure 9:
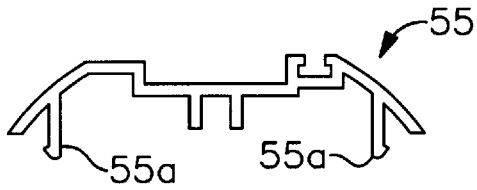
FIG. 9 is an end view of a bottom door sweep.

Door jamb member 54 having an attachment means in the form of outwardly turned truncate flanges 54*a,* 54*a* forms a part of the novel screen door assembly. Bottom door sweep 55 (FIG. 9) having outwardly turned truncate flanges collectively denoted 55*a* forms another part of said screen door assembly.

Figure 10:
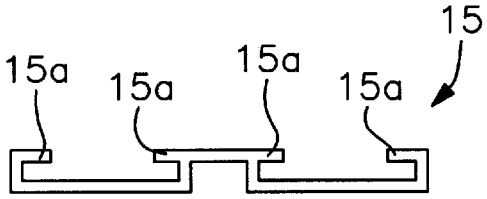
FIG. 10 is an end view of a flat connector.

Flat connector 15, depicted in FIG. 10, includes two pairs of inwardly turned parallel flanges 15*a*. It is essentially an attachment means such as provided as a part of extrusion members 14, 26, and the like.

Figure 11:
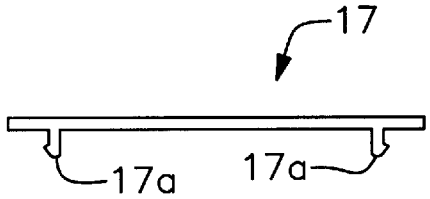
FIG. 11 is an end view of a flat adapter.

Flat adapter 17 of FIG. 11 includes a pair of outwardly turned, truncate flanges 17*a,* 17*a* that serve as the attachment means for that part.

Figure 12:
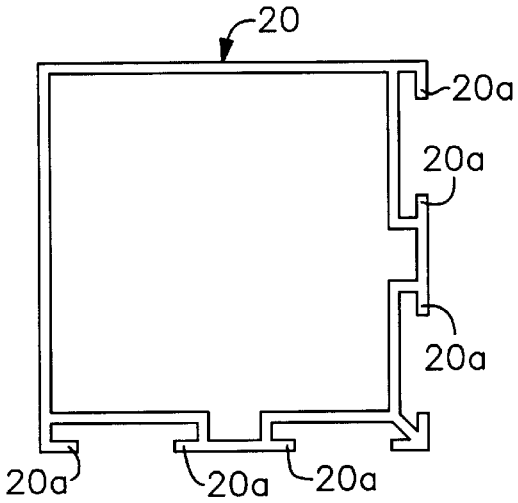
FIG. 12 is an end view of a square corner post.

FIG. 12 depicts a square corner post 20 having pairs of inwardly-turned attachment means 20*a*.

Figure 13:
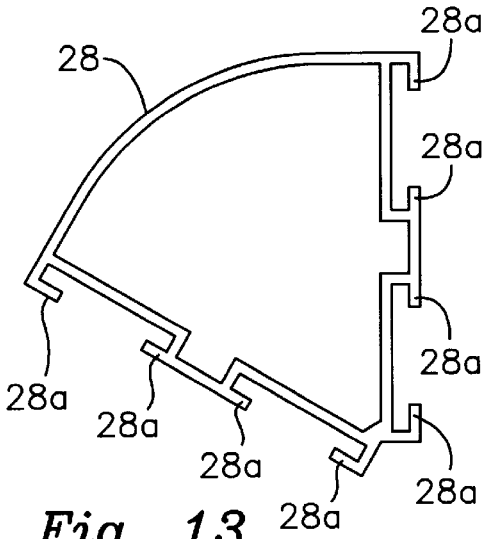
FIG. 13 is an end view of a sixty degree corner connector.

FIG. 13 depicts an angled corner post 28 having pairs of inwardly-turned attachment means 28*a*.

Figure 14:
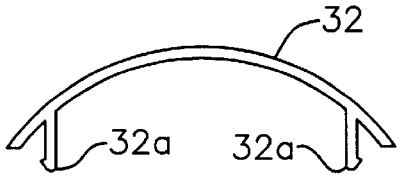
FIG. 14 is an end view of a round snap trim.

Round snap trim member 32 having attachment means 32*a* is depicted in FIG. 14. See FIG. 30 for an example of one of its usages. It is provided for aesthetic purposes only in that it performs no screen-engaging function.

Figure 15:
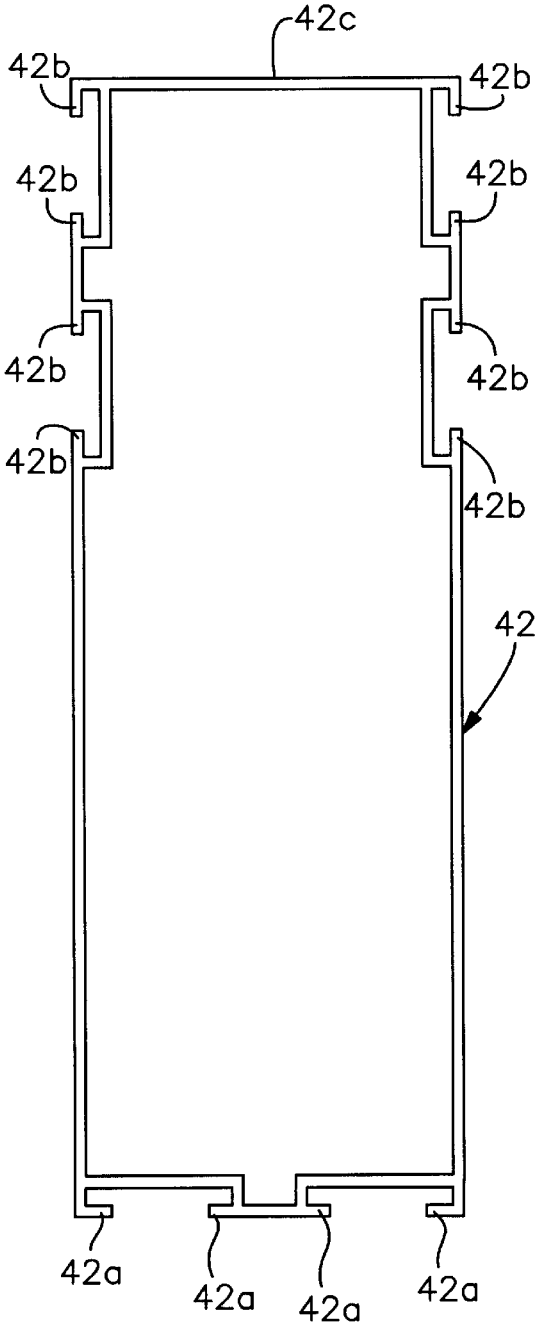
FIG. 15 is an end view of a side connecting beam.
Figure 30:
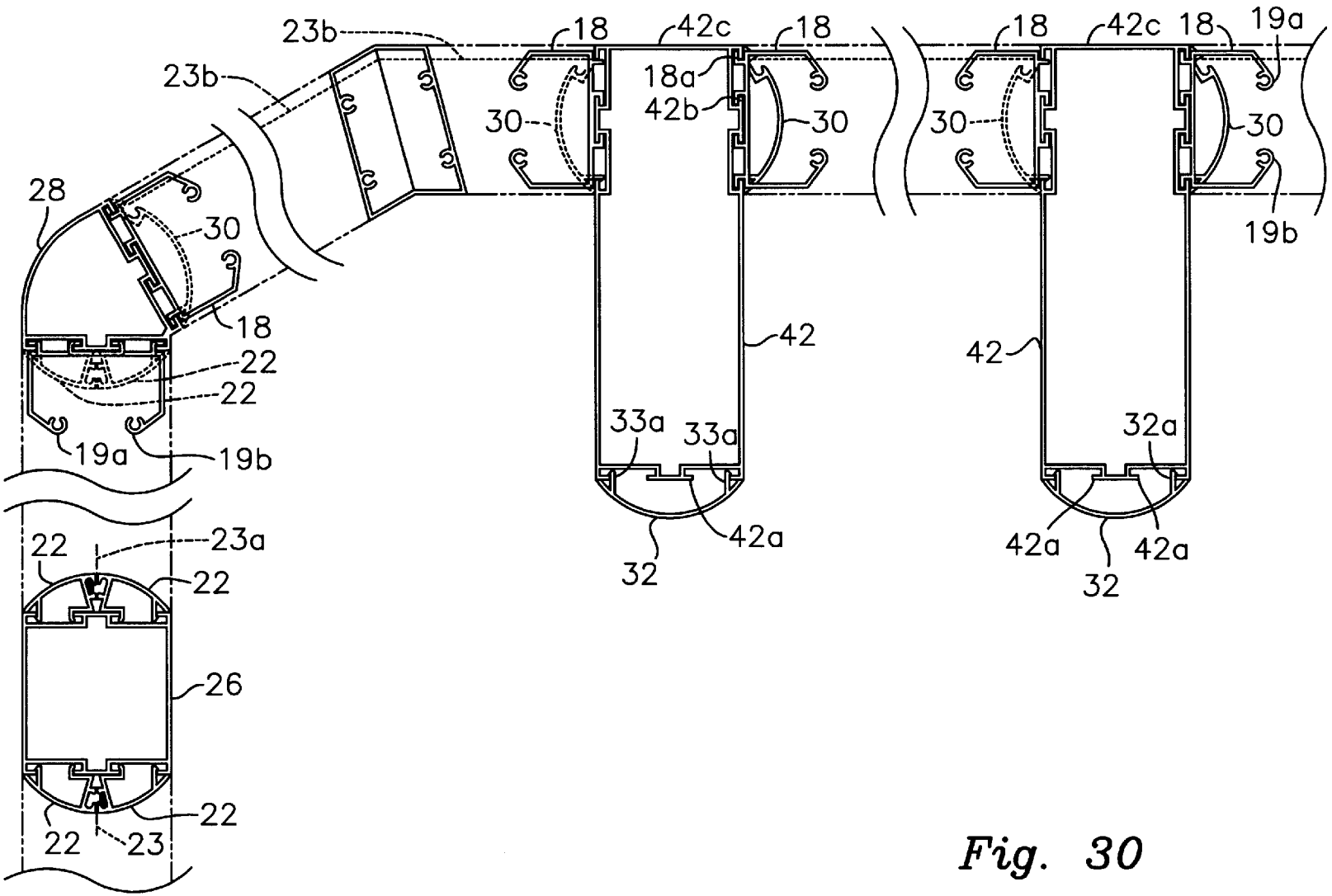
FIG. 30 is a side elevational, broken view of a part of the novel pool enclosure similar to that of FIG. 29, but depicting an alternate roof beam assembly.

Side connecting beam 42 is depicted in FIG. 15. Attachment means 42*a* are formed in its bottom wall and attachment means 42*b,* 42*b* are formed in each of its side walls near respective uppermost ends thereof, and no attachment means are formed in top wall 42*c* thereof. FIG. 30 provides a good view of this beam in use.

Figure 16:
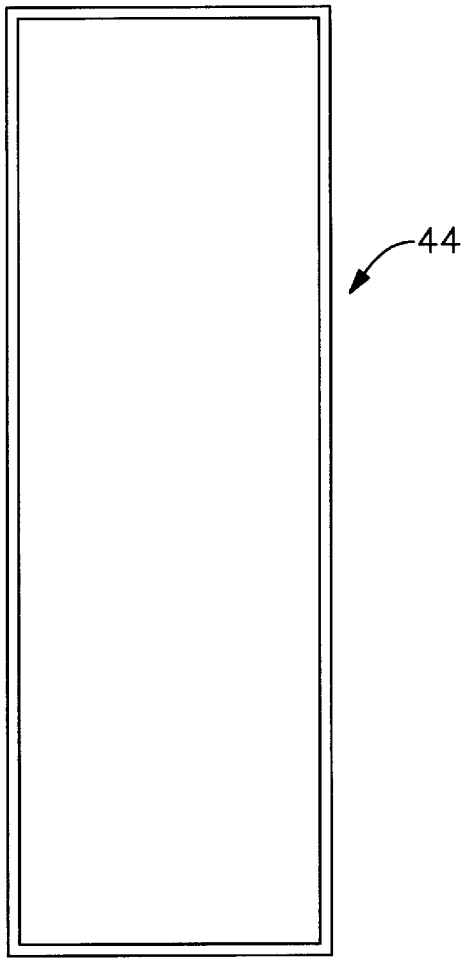
FIG. 16 is an end view of a splice extrusion beam.
Figure 18A:
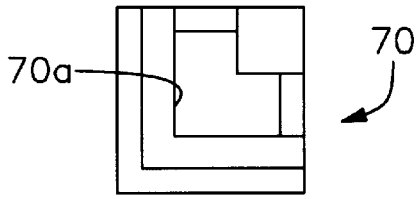
FIG. 18A is a plan view of a first bracket for a square corner connection.
Figure 18B:
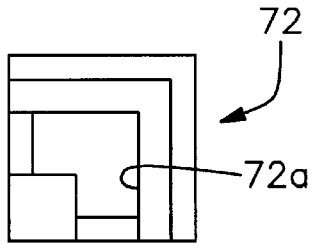
FIG. 18B is a plan view of a second bracket for a square corner connection.
Figures 29, 29A:
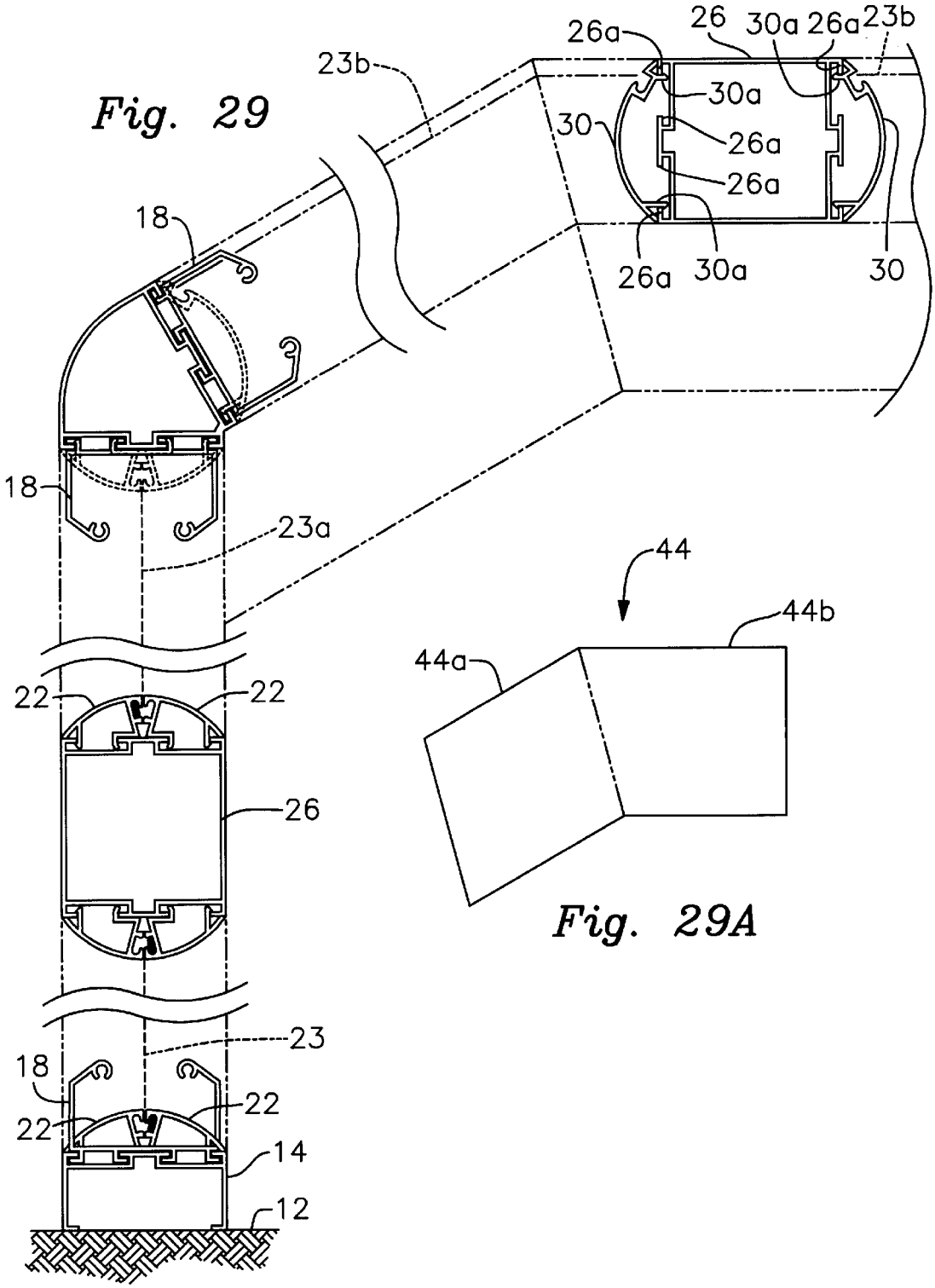
FIG. 29 is a side elevational, broken view of a part of the novel pool enclosure, and includes end views of a base assembly, a chair rail assembly, an assembly that interconnects an outer wall and the roof of the enclosure, and a roof beam assembly.
FIG. 29A is a side elevational view of a box beam splice extrusion used to interconnect adjoining parts depicted in FIG. 29.

Beam splice extrusion 44 of parallelepiped construction is depicted in FIG. 16 and a variant form thereof is depicted in FIG. 29A. As its name implies, it is inserted within abutting ends of a pair of hollow extrusions to help interconnect them in an end-to-end abutment situation. The bent form of the beam splice extrusion, depicted in FIG. 29A, is employed when the two hollow extrusions are meeting at an angle.

Having considered the various extrusions individually, there use in the aesthetic pool enclosure of FIG. 1 will now be described.

Figure 34:
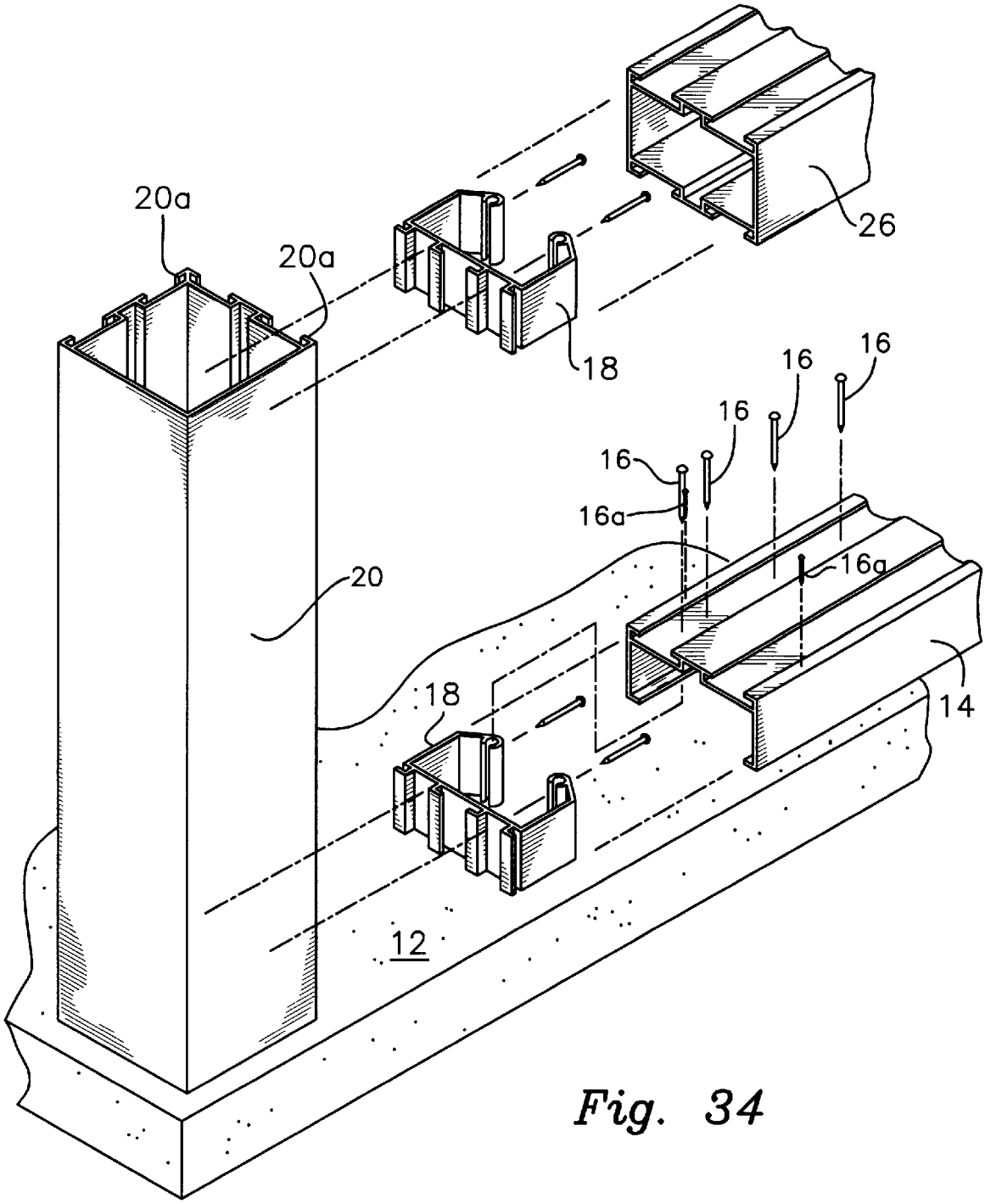
FIG. 34 is an exploded perspective view depicting a lower corner of the novel pool enclosure assembly.

As perhaps best understood by considering FIG. 1 with FIGS. 4, 29 and 34, open-back beam 14 is secured in overlying relation to concrete slab 12 by a plurality of suitable fastening members, collectively denoted 16 in FIG. 34. Connecting bracket 18 (FIG. 3) closes each opposite end of open-back beam 14. Specifically, fastener-engaging sleeves 19*a,* 19*b* are inserted into the hollow interior of said open-back beam 14 and outwardly turned attachment means 18*a* are positioned flush with their respective open ends; fasteners 16*a* (FIG. 34) engage sleeves 19*a,* 19*b* to hold the assembly together.

Figure 25:
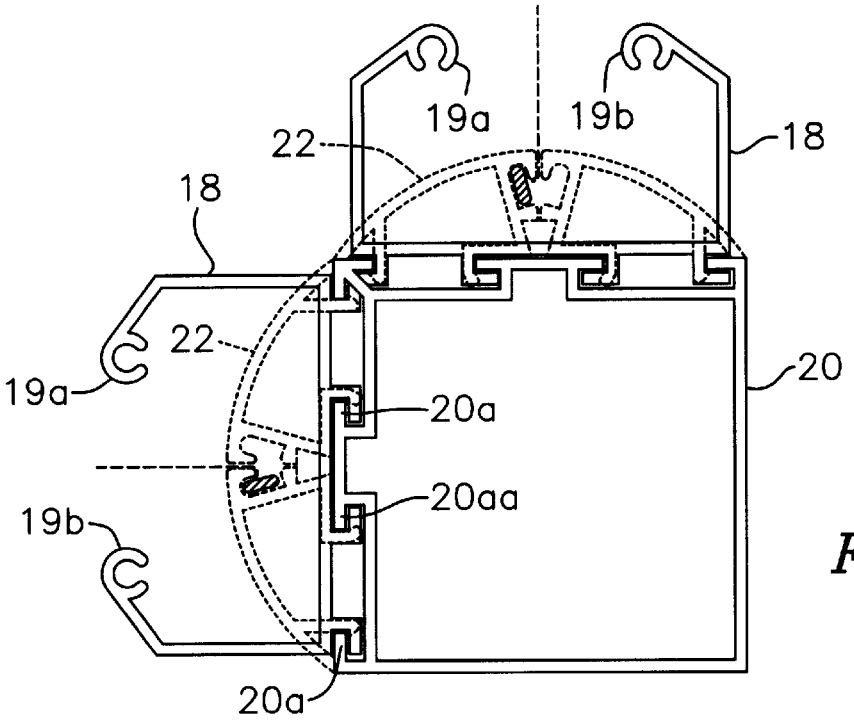
FIG. 25 is an end view of an assembly of the parts depicted in FIGS. 3 and 12 and including a phantom view of the parts depicted in FIG. 5A.

Square corner post 20 (FIG. 12) having two sides equipped with interlocking means 20*a* is then interlockingly engaged to connecting bracket 18 in the manner depicted in FIG. 25.

It should be understood, however, that the sequence of construction just described herein is not critical and that the construction steps may follow many different routes. For example, corner beam 20 and connecting bracket 18 can be assembled to one another first, with connection of open-back beam 14 occurring thereafter, and so on.

Advantageously, open back beam 14 is not just used in a horizontal configuration where it overlies concrete slab 12; it is also used in upstanding configuration as a post means. More particularly, as depicted at the left end of FIG. 1, an upstanding open-back beam 14 is anchored by suitable means to an existing wall of the structure to which pool enclosure 10 is attached. The interconnecting means 18*a* of a connecting bracket 18 engages interconnecting means 14*a* of said open-back beam 14 to provide a secure interconnection. The interconnection, like all other interconnections in the novel structure, includes a snap-fit.

In some applications, flat connector 14*b* (FIG. 10) replaces open-back beam 14. Note that said flat connector 14*b* is formed by eliminating the side walls of said open-back beam 14, retaining only the part thereof that carries attachment means 14*a*.

Figure 22:
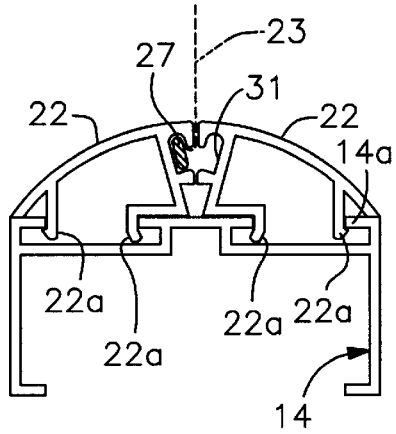
FIG. 22 is an end view of an assembly of the parts depicted in FIGS. 4 and 5A.

As perhaps best understood in connection with FIGS. 1, 5, and 22, a pair of confronting rounded clips, collectively denoted 22, are snap-fittingly interconnected to open-back beam 14 to aesthetically cover interconnecting means 14*a;* such interconnection also covers the interconnecting means 22*a* of said clips 22. Just as importantly, as indicated in FIG. 22, said confronting clips 22 tightly engage a screen 23 therebetween when a conventional rubber or synthetic rubber spline is inserted in the respective spline-holding cavities formed therein. The cavities are not numbered to avoid cluttering the drawings but those of ordinary skill in the art will understand how to install screen 23 in view of this disclosure. The splines may be of the flat type as depicted in FIGS. 5A and 5B or of the round type, not depicted.

Figure 24:
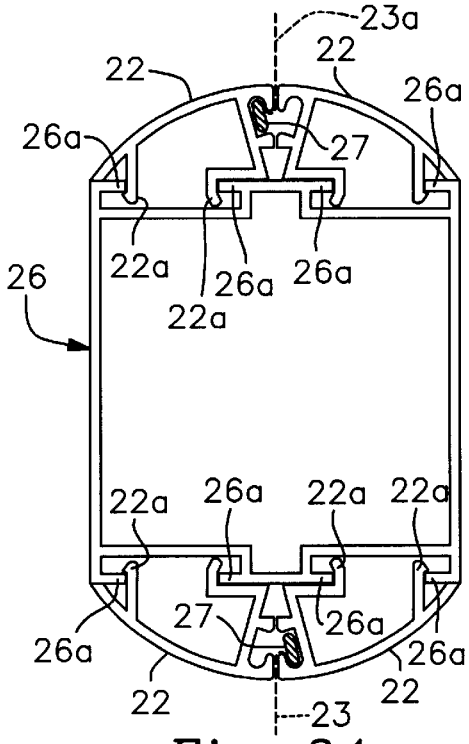
FIG. 24 is an end view of an assembly of the parts depicted in FIGS. 2 and 5A.

A horizontal chair rail 24 (FIG. 1) is positioned above the open-back beam 14 that overlies concrete slab 12, in spaced-apart relation thereto. Extrusion 26 (FIGS. 1 and 2) having interconnecting means 26*a,* 26*a* at its opposite ends and a confronting pair of rounded clips 22 which are interlocked to said extrusion 26 at its upper and lower sides in the manner indicated in FIG. 24 collectively form said chair rail. Rounded clips 22 on the lower side of extrusion 26 engage between them screen 23 extending upwardly from base open-back beam 14. The rounded clips 22 on the upper side thereof engage the lower end of a screen section 23*a* that extends upwardly therefrom as indicated in FIGS. 1 and 24.

Figure 21:
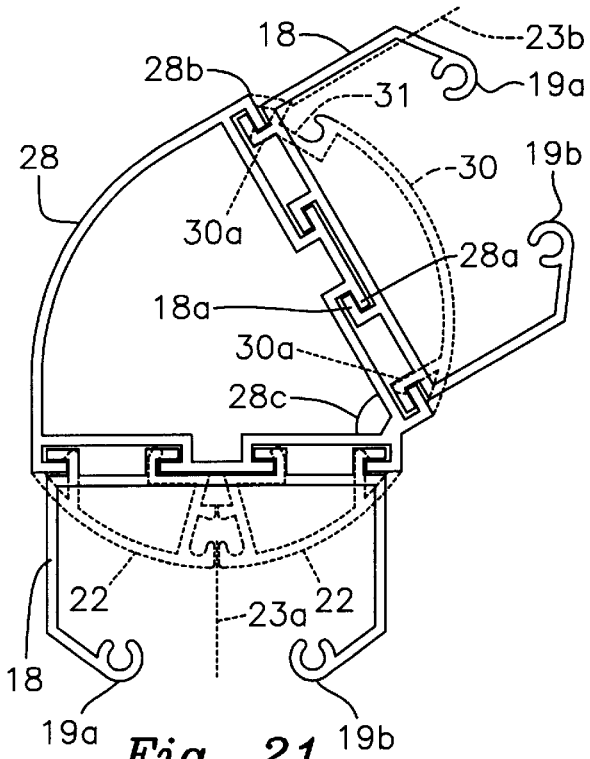
FIG. 21 is an end view of an assembly of the parts depicted in FIGS. 3 and 13 and including a phantom view of the parts depicted in FIGS. 5A and 6.

As best understood in connection with FIGS. 1 and 21, the uppermost edge of vertical screen 23*a* that extends upwardly from chair rail 24 is engaged by another pair of confronting rounded clips 22. More particularly, interconnecting means 22*a* of said rounded clips 22 engage interconnecting means 28*a* of corner connector 28 (FIGS. 13 and 21). Connecting brackets 18 also interlock with corner connector 28 at those locations along the downwardly facing extent of corner connector 28 where an upstanding post intersects with said corner connector and at those locations where a roof beam interconnects with said corner connector.

The mounting of a vertically-extending screen midway between a pair of confronting, rounded clips 22, 22 presents an aesthetic appearance because said clips 22, 22 conceal the various interconnecting and fastening means of this invention. However, such a mounting for a screen in the roof section of the pool enclosure could cause leaves or other debris to accumulate on the roof of the enclosure.

Accordingly, the inventive structure includes a top snap member 30 having interconnecting means 30*a* and a flat spline cavity 31 at a first end thereof (FIGS. 6 and 21). As best understood in connection with FIG. 21, a roof screen 23*b* having its lowermost edge retained in cavity 31 by a flat spline (or round spline if rounded clip 22 having a round spline is used) is positioned nearly flush with the uppermost point of corner connector 28. This minimizes the amount of debris that could collect between the screen and said uppermost point. In FIG. 21, said uppermost point is denoted 28*b*.

In a preferred embodiment, included angle 28*c* (FIG. 21) is sixty degrees; this provides a thirty degree slope to screen 23*b* as should be clear from FIGS. 1, 21 and 30.

As best understood in connection with FIGS. 1, 15 and 30, the primary weight bearing roof beams are provided by side connecting beams 42. As indicated in FIG. 15, each side connecting beam 42 has a flat top wall 42*c,* a bottom wall having attachment means 42*a* formed therein, and opposed sidewalls having attachment means 42*b,* 42*b* formed therein along a preselected extent thereof near said top wall. Rounded top snap members 30 (FIG. 6) having attachment means 30*a* are snap fittingly engaged to attachment means 42*b*. This aesthetically conceals attachment means 42*b* as well as attachment means 30*a* of each rounded top snap member 30. Round snap trim 30 (FIG. 14) having attachment means 32*a,* 32*a,* is snap-fittingly engaged to attachment means 42*a* of said side connecting beam 42 for aesthetic purposes as well.

Similarly, as best understood in connection with FIGS. 1, 6 and 29, roof beams 40*a* and 40*b* are formed by covering attachment means 26*a* of extrusion 26 (FIG. 2) by rounded top snap members 30.

FIG. 29A depicts a splice member 44 having a first part 44*a* and a second part 44*b*. First part 44*a* is slidingly received within the uppermost open end of sloped extrusion 40*a* and second part 44*b* is slidingly received in the open end of horizontal extrusion 40*b*. Splice member 44 is hollow, having a box-like construction; it performs the function of aligning said sloped and horizontal extrusions with one another and strengthening the joint thereby made.

As indicated in FIGS. 15 and 30, attachment means 42*b* of side connecting beam 42 snap-fittingly engages attachment means 18*a* of connecting bracket 18 as best depicted in FIG. 30 to facilitate attachment of horizontal roof beams 40*b* thereto. The snap fit engagement of attachment means 42*b* and attachment means 30*a* of top snap member 30 (FIG. 6) is in the linear areas apart from the junctures of sloped beams 40*a* and horizontal beams 40*b*.

Figure 23:
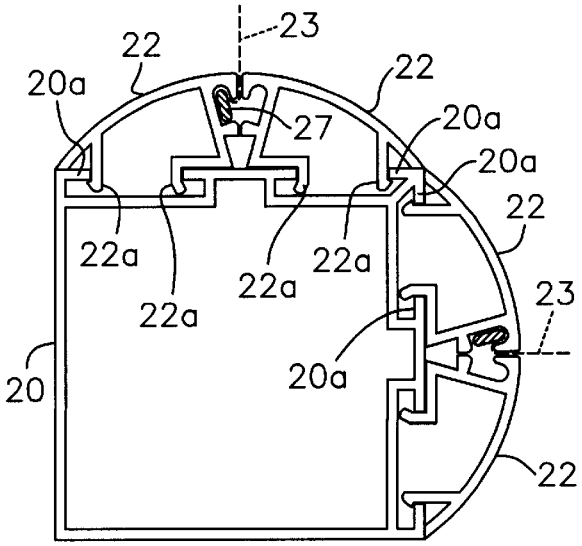
FIG. 23 is an end view of an assembly of the parts depicted in FIGS. 5A and 12.

FIG. 23 indicates how confronting rounded clips 22 having flat splines (FIG. 5A) are secured by snap fit to a corner post 20, and FIG. 24, as already mentioned, depicts said rounded clips 22 when snap fit to extrusion 26 of FIG. 2. Rounded clips having rounded splines (not shown) and tapered clips having flat splines (FIG. 5B) or rounded splines (not shown) may also be used, depending upon the preference of the customer.

FIG. 25, as also mentioned earlier, depicts the interconnection of corner post 20, connecting brackets 18 and confronting rounded clips 22.

Figure 26:
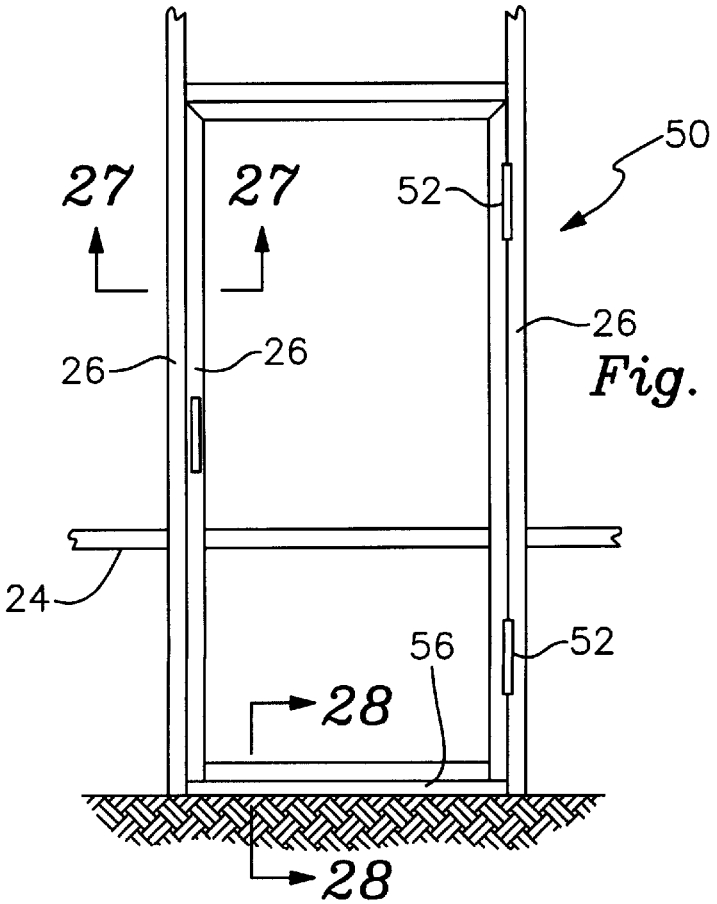
FIG. 26 is an elevational view of a screen door construction that forms a part of the novel pool enclosure.
Figure 27:
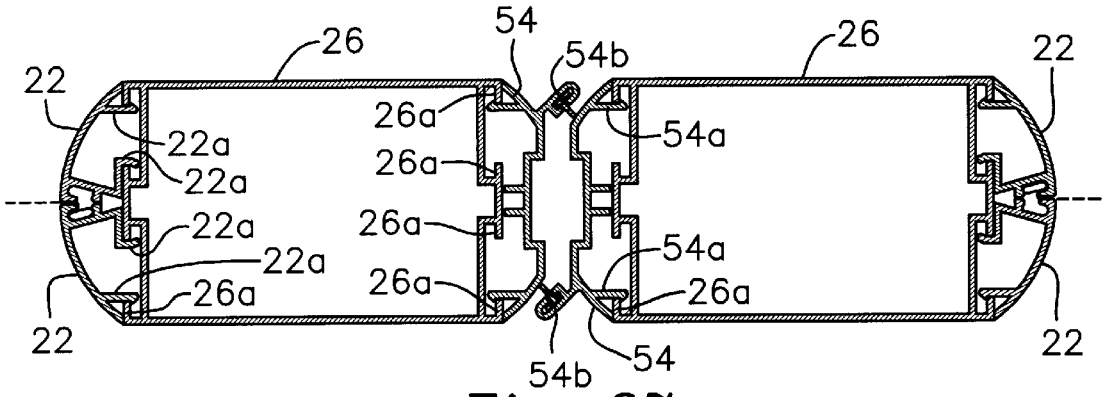
FIG. 27 is a sectional view taken along line 27—27 in FIG. 26, and depicts an assembly of parts disclosed in FIGS. 2, 5A and 8.

FIG. 26 depicts a screen door 50 having self-biased hinges 52 that eliminate the need for a conventional hinge mechanism of the type including an unsightly air cylinder and a piston slideably connected thereto. Advantageously, the frame of door 50 is extra sturdy, being built, as indicated in FIG. 27, by confronting extrusion members 26, 26 having their respective outboard sides aesthetically covered by screen-engaging confronting rounded clips 22 and having their confronting attachment means 26*a,* 26*a* in snap-fit engagement with doorjamb members 54 (FIG. 8) having attachment means 54*a*. Felt strips 54*b* are held by said respective door jams and quieten the operation of the door.

Figure 8:
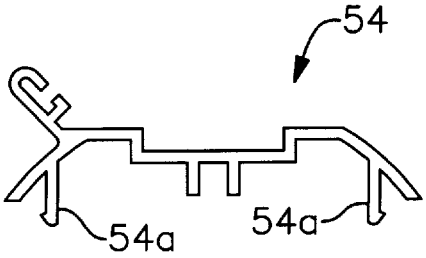
FIG. 8 is an end view of a doorjamb.
Figure 28:
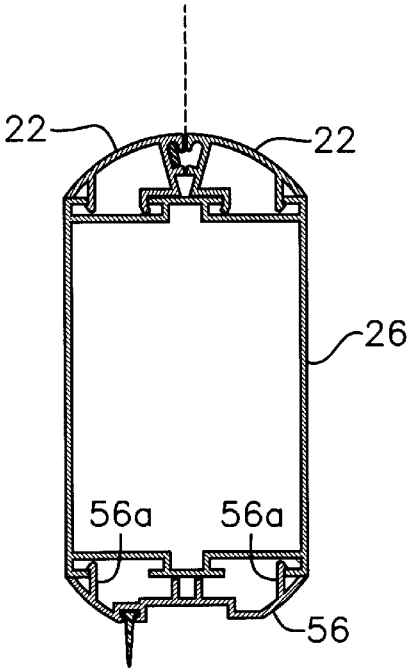
FIG. 28 is a sectional view taken along line 28—28 in FIG. 26, and depicts an assembly of parts disclosed in FIGS. 2, 5A and 9.

The bottom door sweep is also exceptionally sturdy, being built of extrusion 26 (FIG. 2), confronting rounded clips 22 and bottom door sweep member 56 having attachment means 56*a,* 56*a* (FIGS. 8 and 26 and 28).

FIGS. 17, 18A, 18B, 19A, 19B, 31 and 32 show how the novel structure is fastened to a gutter means of an existing structure and how various right and left turns are structured so that the novel pool enclosure can be adapted for use in a wide variety of differing environments.

Figure 17:
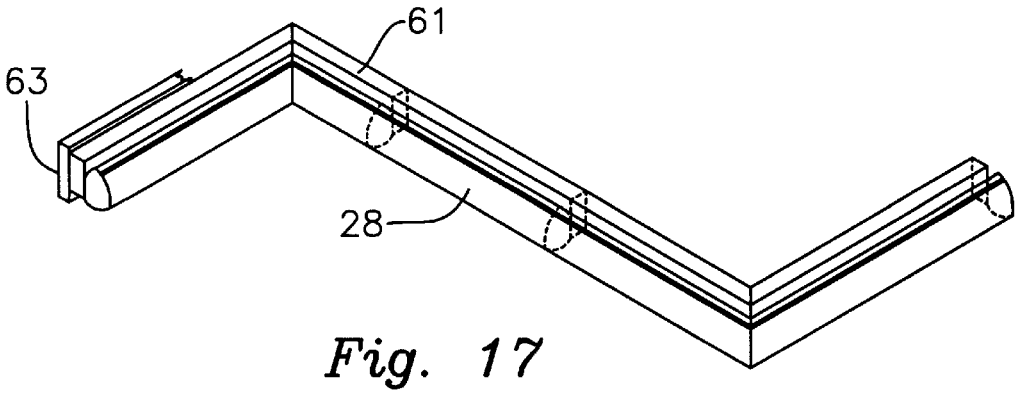
FIG. 17 is a perspective view of a gutter turn-in and turn-out connection assembly.
Figure 31:
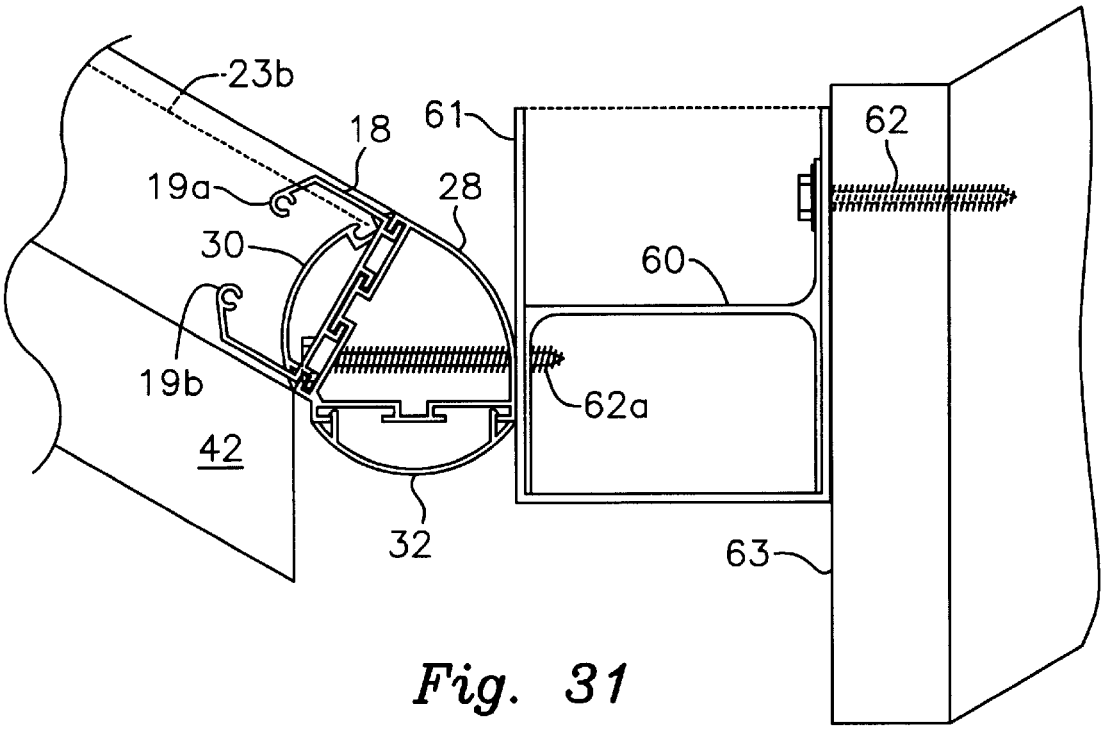
FIG. 31 is a side elevational view depicting a first means for connecting the novel assembly to a gutter.

In the example of FIGS. 17 and 31, a gutter support 60 is positioned inside pool gutter 61 and the gutter and support are fastened by fastening members 62, only one of which is shown, to a pre-existing fascia 63. Additional fastening members 62*a* secure sixty degree corner connector 28 (FIG. 13) to gutter 60 and gutter support 61. Round snap trim 32 (FIG. 14) snap-fittingly engages the bottom surface of corner connector 28 for aesthetic purposes. Top snap 30 engages the angled surface of said corner connector so that screen 23*b* is positioned in substantially flush relation to sloped beams 40 or 42, and connecting bracket 18 serves as the interconnecting means for sloped beam 40 or 42 and said angled surface of corner connector 28.

Figure 32:
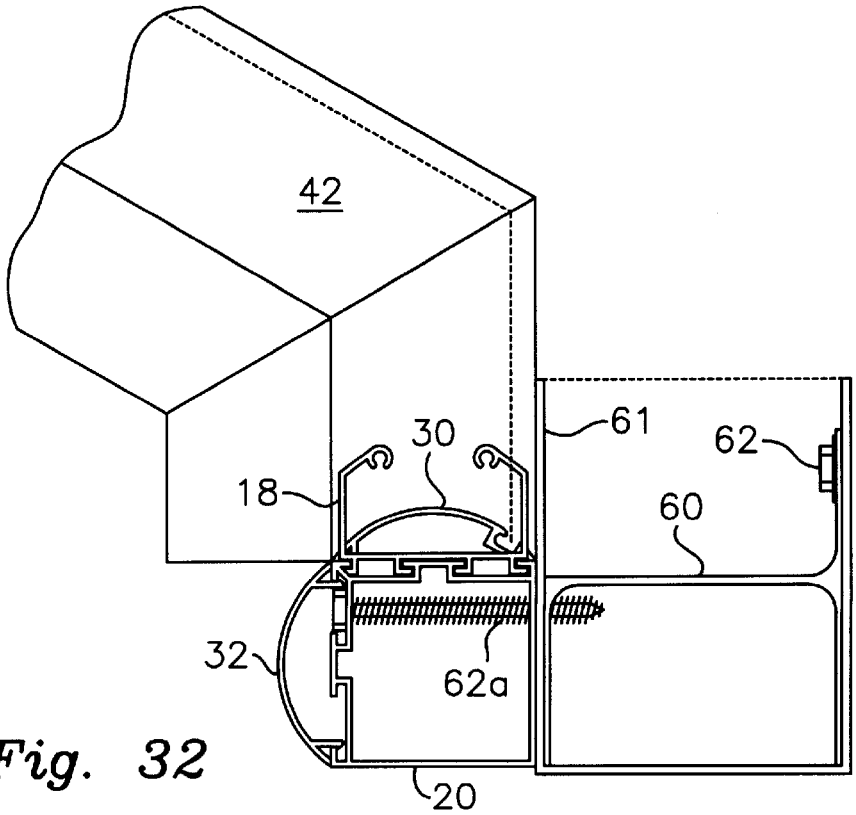
FIG. 32 is a side elevational view depicting a second means for connecting the novel assembly to a pool gutter.

In the alternative construction of FIG. 32, corner post 20 (FIG. 12) is secured to gutter 61 by fastening means 62*a* and round snap trim member 32 (FIG. 14) is snap-fittingly engaged to and overlies an exposed surface thereof for aesthetic purposes. Screen-retaining top snap member 30 (FIG. 6) snap fittingly engages the other attachment-means-carrying surface of corner post 20, and connecting bracket 18 is used to interconnect said corner post 20 and extrusion 26 (FIG. 2). A box beam splice such as member 44 (FIG. 29A) interconnects extrusions 26 and 42 so that the latter is sloped at a thirty degree angle or so, relative to horizontal.

As best understood in connection with FIG. 17, provision has been made to adapt the above-described gutter connections to applications where one or more left or right (inside or outside) turns are needed. Box-shaped castings 70 (FIG. 18A) or 72 (FIG. 18B) have openings 70*a* and 72*a* respectively formed therein. They are slide-fittingly installed in abutting ends of corner posts 20 to strengthen such joints. Corner posts 20 are horizontally disposed as indicated in FIGS. 17 and 31 when used to connect the novel pool enclosure assembly to gutter means 61. Generally "T" shaped castings 74 (FIG. 19A) or 76 (FIG. 19B) are slide-fittingly installed in abutting ends of corner connectors 28. The casting used depends upon whether the turn is an inside or an outside turn.

Figure 19A:
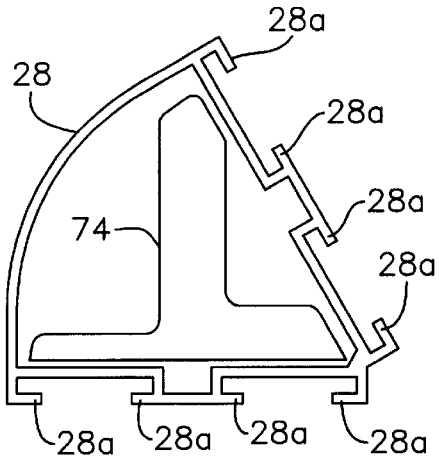
FIG. 19A is an end view of a first sixty degree corner connector.
Figure 19B:
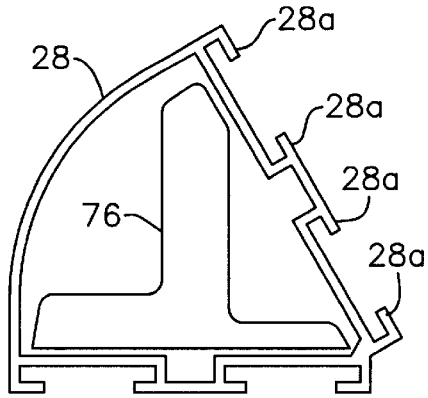
FIG. 19B is an end view of a second sixty degree corner connector.
Figure 33A:
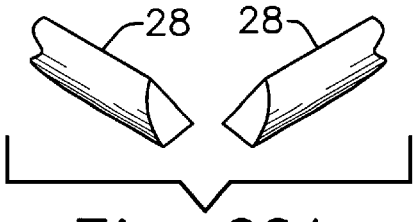
FIG. 33A is a perspective view of the corner connectors of FIG. 13 having forty five degree miter cuts in their respective mating ends.
Figure 33B:
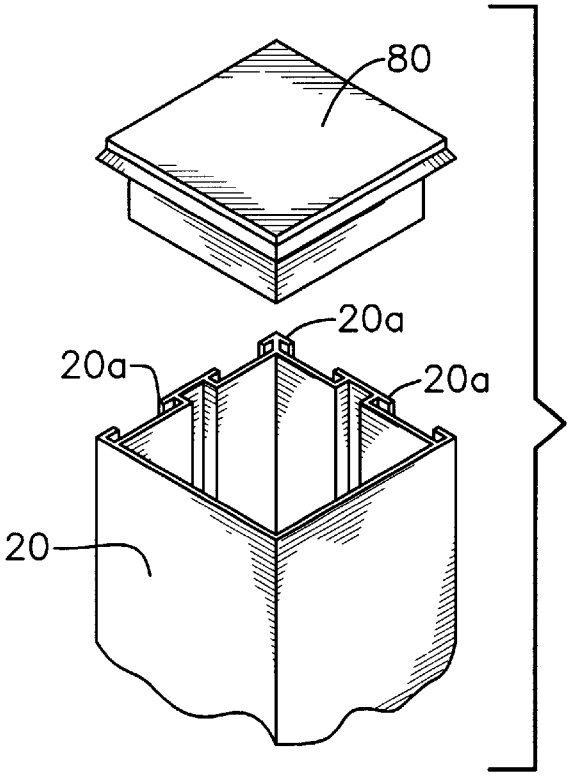
FIG. 33B is an exploded perspective view of a casting for capping the square corner post of FIG. 12.
Figure 33C:
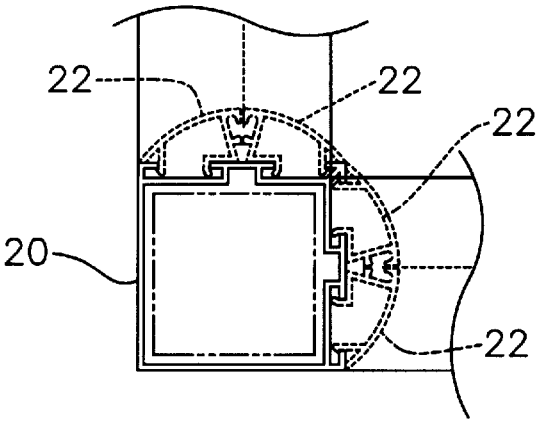
FIG. 33C is a plan view of the casting of FIG. 33B, including the parts of FIG. 5A in phantom lines.

A casting 80 used for joining together abutting corner connectors 28 at a vertical corner post 20 is depicted in FIG. 33B, which Fig. is best understood when considered in connection with FIGS. 33A and 33C. Casting 80 is slideably inserted into the uppermost end of upstanding corner post 20 and mitered corner connectors 28, 28 abut one another in overlying relation to said casting 80. The "T"-shaped castings 74, 76 of FIGS. 19A, 19B are selectively slideably received within said corner connectors, the particular casting selected depending upon the direction of the turn.

The finished assembly, unlike all prior art pool enclosures, has no visible fastening members, rubber splines, door-closing assemblies, and the like. The enclosure has the smooth appearance of a molded product, complete with rounded or tapered covers for the posts, beams, and other miscellaneous parts. No leaves or other debris are trapped atop the horizontal or sloped sections of the screen due to the flush mounting of the screen made possible by top snap member 30 (FIG. 6). Assembly is easy, due to the snap-fit attachment between the sundry parts. The modular nature of the structure and the ease of cutting aluminum parts to length enables contractors to build the enclosure quickly and hence economically.

The striking beauty of the novel enclosure greatly enhances the value of the house to which it is connected.

It will thus be seen that the objects set forth above, and those made apparent from the foregoing descrption, are efficiently attained. Since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus for forming an enclosure, comprising:

a plurality of extrusion members for providing posts and beams that collectively form an enclosure when assembled;

each of said extrusion members having at least a first wall with an attachment means formed thereon along the extent thereof;

a plurality of aesthetic cover members in snap-fit engagement with said attachment means to conceal said attachment means;

each aesthetic cover member of said plurality of cover members having a first side in snap-fit engagement with an associated attachment means and a second side providing an aesthetic cover;

each aesthetic cover member including a pair of barbed flanges, said flanges permitting said snap-fit engagement but preventing disengagement of a cover member from its associated extrusion member after a snap-fit engagement is accomplished;

each aesthetic cover member including a screen-engaging means positioned between said first side and said second side so that said screen-engaging means is concealed when said enclosure is assembled;

each screen-engaging means being formed independently of and being spaced apart from said attachment means;

whereby said attachment means and said screen-engaging means are concealed from view when said pool enclosure is fully assembled; and whereby attachment of said aesthetic cover members to their respective extrusion members is accomplished independently of attachment of a screen to said aesthetic cover members.

2. The enclosure of claim 1, wherein said plurality of aesthetic cover members includes a pair of confronting cover members, and wherein each member of said pair has a first side snap-fittingly engaging an associated attachment means and a second side providing an aesthetic cover.

3. The enclosure of claim 2, wherein each cover member of said pair of confronting cover members has an outboard end and an inboard end, and wherein said respective inboard ends of said confronting cover members includes screen-engaging means engaging an edge of a screen.

4. The enclosure of claim 1, further comprising:

an aesthetic top cover member having a first side snap-fittingly engaging said attachment means along a predetermined extent thereof and having an aesthetic second side including screen-engaging means for engaging an edge of a screen;

said screen-engaging means of said top cover member being positioned adjacent an edge of said aesthetic first side of said top cover member and said second side of said top cover member snap-fittingly engaging beams that form a part of a roof of said enclosure, said edge-mounting of said screen-engaging means positioning a screen in substantially flush relation to the extrusions that form a part of said roof so that debris atop said roof is not retained by said top cover member.

5. The enclosure of claim 1, wherein said plurality of extrusion members includes a plurality of first extrusion members, of elongate construction, having a generally rectangular transverse cross section, having first and second flat side walls and having third and fourth walls disposed normal to said side walls, said attachment means being formed integrally with said third and fourth walls.

6. The enclosure of claim 1, wherein a second extrusion member of said plurality of extrusion members is a connecting bracket having a first wall with attachment means formed therein, having a pair of side walls disposed normal to said first wall, having a bend formed in each of said side walls so that their respective free ends are closer to one another than the respective ends thereof connected to said first wall, and having a fastener-receiving sleeve formed in a free end of each of said side walls, said connecting bracket being sized so that said side walls are slideable into an open end of a preselected extrusion member until said first wall is substantially flush with said open end.

7. The enclosure of claim 1, wherein a third extrusion member of said plurality of extrusion members is an open back extrusion member having a first wall with attachment means formed therein, a pair of side walls disposed normal to said first wall, and a flange formed in a free end of each of said side walls, each flange being disposed in substantially parallel relation to said first wall and each flange overlying a support surface.

8. The enclosure of claim 1, wherein a fourth extrusion member of said plurality of extrusion members is an elongate corner post that is square in transverse cross section and where two contiguous walls thereof are flat and where two contiguous walls thereof have said attachment means formed therein.

9. The enclosure of claim 1, wherein a fifth extrusion member is a corner connector having two walls disposed at a predetermined acute angle with respect to one another, each of said two walls having an attachment means respectively formed therein, and having an aesthetic, arcuate wall opposite said acute angle.

10. The enclosure of claim 9, wherein said predetermined acute angle is about sixty degrees.

11. The enclosure of claim 1, wherein a sixth extrusion member is a side connecting beam having a flat top wall, a bottom wall having attachment means formed therein, and a pair of side walls, each of which has an attachment means formed therein along a predetermined extent thereof.

12. The enclosure of claim 3, further comprising:

a screen door frame that forms a part of said pool enclosure;

a screen door hingedly mounted in said screen door frame;

said screen door frame including a first preselected extrusion member of said plurality of extrusion members;

a first door jamb extrusion member snap-fittingly engaged to a first preselected attachment means formed in said first preselected extrusion member;

a first pair of said confronting cover members snap-fittingly engaged to a second preselected attachment means formed in said first preselected extrusion member;

said screen door including a second preselected extrusion member of said plurality of extrusion members;

a second door jamb extrusion member snap-fittingly engaged to a first preselected attachment means formed in said second preselected extrusion member;

a second pair of said confronting cover members snap-fittingly engaged to a second preselected attachment means formed in said second preselected extrusion member;

said first and second door jamb extrusion members disposed in confronting relation to one another when said screen door is closed; and said first and second preselected extrusion members being disposed in an upstanding configuration.

13. The enclosure of claim 12, wherein said first and said second preselected extrusion members are said first extrusion members.

14. The enclosure of claim 12, further comprising a pair of self-biased hinge means for mounting said screen door to said door jamb.

15. The enclosure of claim 12, further comprising:

a third preselected extrusion member disposed in a horizontal configuration to form a bottom frame of said screen door;

an extruded bottom door sweep snap-fittingly engaged to a first preselected attachment means formed in said bottom door sweep; and a pair of confronting cover members snap-fittingly engaged to a second preselected attachment means formed in said bottom door sweep.

16. The enclosure of claim 15, wherein said third preselected extrusion member is said first extrusion member.

17. The enclosure of claim 2, wherein said aesthetic second side of each of said confronting cover members is arcuate in configuration so that said confronting cover members collectively form a rounded surface.

18. The pool enclosure of claim 2, wherein said aesthetic second side of each of said confronting cover members is tapered in configuration so that said confronting cover members collectively form a peaked surface.

* * * * *